United States Patent [19]

Ridgeway

[11] 3,980,510

[45] Sept. 14, 1976

[54] NITROPARAFFIN EXPLOSIVE COMPOSITION CONTAINING HYDRAZINE AND DIETHYLENETRIAMINE

[75] Inventor: John Jerold Ridgeway, Paris, France

[73] Assignee: Imperial Chemical Industries Limited, London, England

[22] Filed: Oct. 29, 1974

[21] Appl. No.: 518,888

[52] U.S. Cl. ..... 149/36; 149/89

[51] Int. Cl.[2] ..... C06B 25/36

[58] Field of Search ..... 149/36, 89

[56] References Cited

UNITED STATES PATENTS

| | | | |
|---|---|---|---|
| 3,116,187 | 12/1963 | Scanlon et al. | 149/89 X |
| 3,132,060 | 5/1964 | Beegle et al. | 149/36 |
| 3,552,126 | 1/1971 | Ahlert et al. | 149/36 X |
| 3,613,373 | 10/1971 | Kaufman | 149/36 X |
| 3,746,588 | 7/1973 | Brunetz et al. | 149/89 |

*Primary Examiner*—Edward A. Miller

*Attorney, Agent, or Firm*—Cushman, Darby & Cushman

[57] ABSTRACT

A self-sterilising liquid explosive composition comprising liquid nitroparaffin, for example nitromethane, sensitised with hydrazine and containing diethylenetriamine as a delayed action sterilising agent.

6 Claims, No Drawings

NITROPARAFFIN EXPLOSIVE COMPOSITION CONTAINING HYDRAZINE AND DIETHYLENETRIAMINE

This invention relates to sensitised liquid nitroparaffin explosive compositions containing a delayed action sterilising agent to render the compositions non-detonable at a convenient time after mixing.

Nitroparaffin explosives are widely used in operations requiring a so-called 'two-component' liquid explosive which can be prepared by the on-site mixing of two non-explosive or insensitive ingredients. Generally one component, in this case nitroparaffin, is the energetic component and the second component is the sensitiser. For nitroparaffins, the sensitising components are generally amines. Such an explosive system has the advantage that the separate components can be handled and transported safely to the blasting site by normal transport, thus eliminating the requirement of the costly shipping and handling methods needed for explosives. Thus, the components can be quickly transported by air to widely distant blasting sites and mixed to provide a high quality blasting explosive. In many blasting operations only such a system could give cost-effective operation.

The mixed 'two-component' explosive is, however, a highly sensitive explosive mixture which will retain its sensitivity indefinitely and any explosive remaining after the blasting operation can be hazardous. Thus, in underwater channelling operations for oil-pipe laying, containers of explosive have been lost due to rough weather conditions and these containers constitute a continuing danger. Further, the usage sites for such explosives are generally ill-provided with magazines for explosive storage so that any explosive surplus to the blast requirements has to be detonated and it is often impractical or inconvenient to detonate surplus explosive at the mixing site. There has therefore been a demand for methods of sterilising two-component systems, and especially for delayed action sterilising agents to desensitise the compositions after a convenient period of storage. Many different compounds, for example carbonyl compounds, have been proposed for this purpose and, although effective, they have been found to impair the ease of initiation to detonation of the originally mixed explosive. It is therefore an object of this invention to provide a method of delayed sterilisation of a 'two-component' nitroparaffin explosive which does not impair the ease of initiation of the explosive when originally prepared.

I have now discovered that liquid nitroparaffin explosives sensitised with hydrazine can be rendered self-sterilising by the inclusion of diethylenetriamine in the composition. This is surprising since nitroparaffins are sensitised by amines. The use of an amine as the delayed desensitising agent ensures that initially the explosive remains as sensitive and easily initiated to detonation as the original mixture of nitroparaffin and hydrazine.

Thus, in accordance with this invention, a self-sterilising explosive composition comprises liquid nitroparaffin, sufficient hydrazine to sensitise the nitroparaffin and render it capable of detonation, and diethylenetriamine as a delayed action sterilising agent.

The time required for the initially sensitive explosive mixture to become incapable of initiation to detonation can be varied by variation of the amount of sterilising agent in the composition. The composition conveniently contains 5 to 15% by weight of hydrazine and 2 to 10% by weight of diethylenetriamine but the amount of diethylenetriamine should preferably not be greater than the amount of hydrazine. Such mixtures will become insensitive and incapable of detonation with a conventional initiator after 3 to 6 hours.

Suitable liquid nitroparaffins include, for example, nitromethane, dinitromethane, nitroethane, dinitroethane, nitropropane and dinitropropane.

The explosive is conveniently prepared by mixing its non-self-explosive ingredients as required at the site where it is to be used. If desired, however, the nitroparaffin and hydrazine only may be mixed together to prepare a sensitive two-component explosive mixture and the diethylenetriamine may be added at any convenient time thereafter. Accordingly, the invention also includes a method of sterilising a sensitive liquid nitroparaffin hydrazine explosive composition wherein diethylenetriamine is mixed with the composition.

The invention is further illustrated by the following Examples, in which all parts are given by weight.

EXAMPLE 1

85 parts of nitromethane and 10 parts of hydrazine were mixed to form a sensitive liquid explosive which could be detonated reliably at a velocity of more than 6.3 km per second in a 25 mm diameter column by means of a No. 8 blasting cap or a length of detonating cord having a core charge of 50 grains per foot of pentaerythritol tetranitrate (PETN).

5 parts of diethylenetriamine were mixed with 95 parts of the thus prepared explosive composition and when tested shortly after mixing, the explosive properties were the same as those of the original explosive composition and these properties were retained for about 3 to 4 hours. After 4 hours the compositions became insensitive and could not be detonated with a No. 8 blasting cap or a length of detonating cord (50 grains per foot of PETN).

EXAMPLE 2

10 parts of hydrazine were mixed with 5 parts of diethylenetriamine and the resulting mixture mixed with 85 parts of nitromethane. The resulting liquid explosive could initially be reliably detonated in a 25 mm diameter column at a velocity of more than 6.3 km per second by a No. 8 blasting cap or a length of detonating cord (50 grains per foot of PETN) but after 4 hours after the final mixing the compositon could not be detonated by a No. 8 blasting cap or a length of detonating cord (50 grains per foot of PETN).

What is claimed is:

1. A self-sterilising explosive composition consisting essentially of a liquid nitroparaffin selected from the group consisting of nitromethane, dinitromethane, nitroethane, dinitroethane, nitropropane and dinitropropane, sufficient hydrazine to sensitise the nitroparaffin and render it capable of detonation, and diethylenetriamine as a delayed action sterilising agent.

2. A composition as claimed in claim 1 comprising from about 75 to about 93% by weight of nitroparaffin, from about 5 to about 15% by weight of hydrazine and from about 2 to about 10% by weight of diethylenetriamine.

3. A composition as claimed in claim 2 wherein the amount of diethylenetriamine is not more than the amount of hydrazine.

4. A compositon as claimed in claim 2 comprising about 85% by weight of nitromethane, about 10% by weight of hydrazine and about 5% by weight of diethylenetriamine.

5. A method of sterilising an explosive composition consisting essentially of a mixture of hydrazine with a nitroparaffin selected from the group consisting of nitromethane, dinitromethane, nitroethane, dinitroethane, nitropropane and dinitropropane in which method diethylenetriamine is mixed into the composition as a delayed action sterilising agent.

6. A composition as in claim 1 wherein the nitroparaffin is nitromethane.

* * * * *